US006046418A

United States Patent [19]

Feiler et al.

[11] Patent Number: 6,046,418

[45] **Date of Patent: *Apr. 4, 2000**

[54] DRIVE SYSTEM FOR SWITCH, ESPECIALLY RELAY

[75] Inventors: Jochen Feiler, Heilbronn; Daniel Josef Jendritza, Dillingen/Saar; Hartmut Janocha, Saarbrücken; Horst Binnig, Neckarsulm, all of Germany

[73] Assignee: Kaco Elektrotechnik GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,382

[22] Filed: Sep. 20, 1997

[30] Foreign Application Priority Data

Sep. 21, 1996 [DE] Germany ..... 196 38 716

[51] Int. Cl.[7] ..... H01H 1/28

[52] U.S. Cl. ..... 200/508; 200/408; 200/549; 200/246

[58] Field of Search ..... 200/246, 247, 200/245, 408, 409, 508, 549, 551

[56] References Cited

U.S. PATENT DOCUMENTS

| | | | |
|---|---|---|---|
| 2,118,528 | 5/1938 | Scott | 200/409 |
| 3,688,135 | 8/1972 | Koda et al. | 200/408 X |
| 3,902,032 | 8/1975 | Koepke | 200/283 |
| 4,658,101 | 4/1987 | Akimoto et al. | 200/551 X |

FOREIGN PATENT DOCUMENTS 2225826 of 0000 France .

*Primary Examiner*—Renee S. Luebke
*Attorney, Agent, or Firm*—Robert W. Becker & Associates

[57] ABSTRACT

A switch includes a contact having at least two contact springs and at least one slide for moving the at least two contact springs in opposite directions between an open position and a closed position of the contact. Movement in opposite directions ensures a long service life of the contact elements at the contact springs and provides sufficient contact pressure.

14 Claims, 3 Drawing Sheets

DRIVE SYSTEM FOR SWITCH, ESPECIALLY RELAY

BACKGROUND OF THE INVENTION

The present invention relates to a drive system for a switch, especially a relay, comprising at least two contact springs which are moveable into a closed or open position by at least one slide.

In relays the contact springs are connected to one another by a slide which is displaced by an armature for closing (making) the contact or opening (breaking) the contact. Upon movement of the slide, the contact springs of the make contact as well as of the break contact are moved in the same direction such that the respective contact is opened or closed. The displacement travel for closing and opening the contacts is relatively large especially because the respective second contact must be entrained along a respective travel path in order to generate the respective pressure between the contact elements. With increasing use, the contact elements are slowly consumed so that the displacement travel for reaching the same contact forces will increase over time.

It is therefore an object of the present invention to provide a drive system of the aforementioned kind such that only short displacement travel for closing or opening of the contact is required.

SUMMARY OF THE INVENTION

A switch with a drive system according to the present invention comprises a contact having at least two contact springs and at least one slide for moving the at least two contact springs in opposite directions between an open position and a closed position of the contact.

Advantageously, the switch further comprises an abutment, wherein the first one of the at least two contact springs rests on the abutment.

Advantageously, the abutment is arranged at a side of the first contact spring facing away from a second one of the at least two contact springs.

The abutment is provided in the vicinity of the slide.

At least the first one of the at least two contact springs is directly connected to the slide.

A second one of the at least two contact springs is connected to the slide.

A second one of the at least two contact springs is preferable positioned in the travel path of the slide.

Advantageously, the at least two contact springs have facing sides and the at least two contact springs each comprise at least one contact element positioned on the facing sides.

The switch may further comprise a power converter for moving the slide.

The power converter is preferable a piezoelectric bending converter.

The switch may also comprise an armature for moving the slide.

The at least two contact springs have a U-shape including two legs and a connecting stay.

The at least two contact springs are elastically prestressed in the closed position of the contact.

The connecting stay is preferably elastically prestressed in the closed position of the contact.

Advantageously, the switch further comprises an abutment, wherein the first one of the at least two contact springs rests on the abutment in the closed position of the contact.

The switch may further comprise a housing and an abutment connected to the housing, wherein the first one of the at least two contact springs rests on the abutment.

In the inventive drive system for a switch, the two contact springs are simultaneously moved in opposite directions. Accordingly, the displacement travel for closing or opening the contact is minimal. Even with increased use resulting in the contact elements being slowly consumed, the opposite movement of the contact springs ensures that the contact springs in the closed position exert sufficient pressure for contacting one another. The inventive embodiment no longer requires that, when the two contact springs have come into contact with one another, the other contact must still be entrained along a certain travel path. This so-called follower path is eliminated with the inventive embodiment. The required contact force is provided by the opposite movement and by the springs bending past the point of contacting. Due to this opposite movement of the contact springs, a very short travel path and thus a very short switching times are obtained.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 11.

Figure 1:
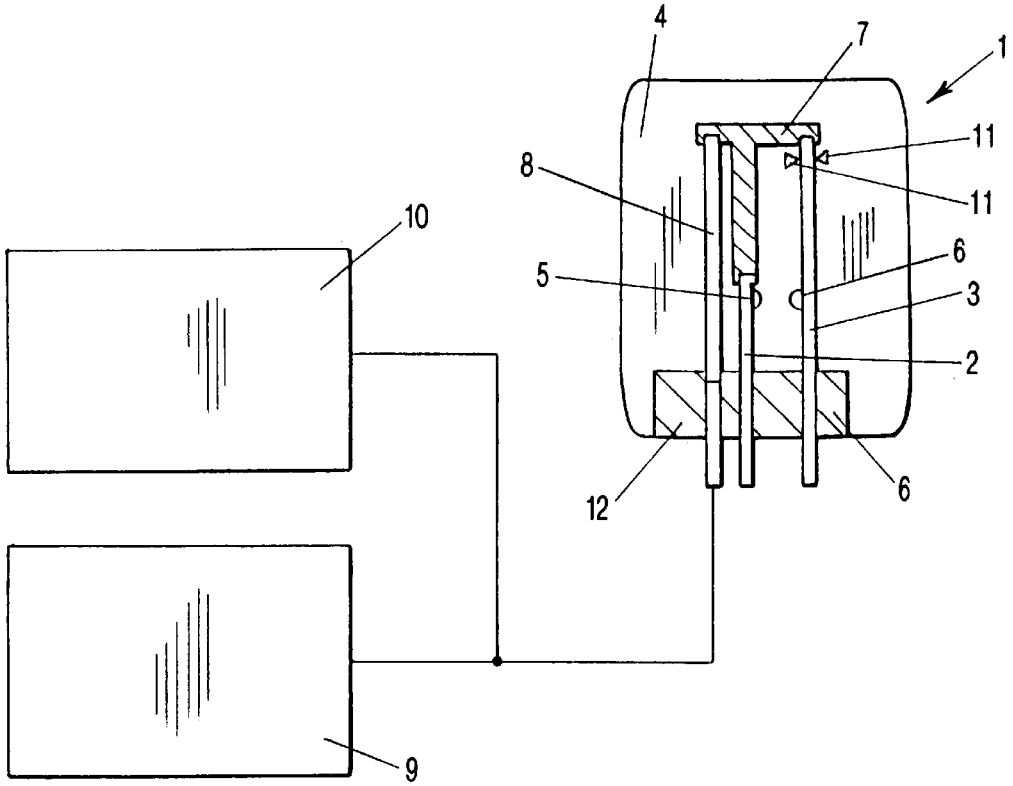
FIG. 1 shows a schematic representation of the first embodiment of the inventive switch drive system in the rest position.

FIG. 1 shows a switch which in the shown embodiment is a relay. The switch 1 can, for example, be a high speed circuit breaker, an undervoltage circuit breaker, a residual current operated device etc. In the following, a switch 1 in the form of a relay will be disclosed.

Figure 2:
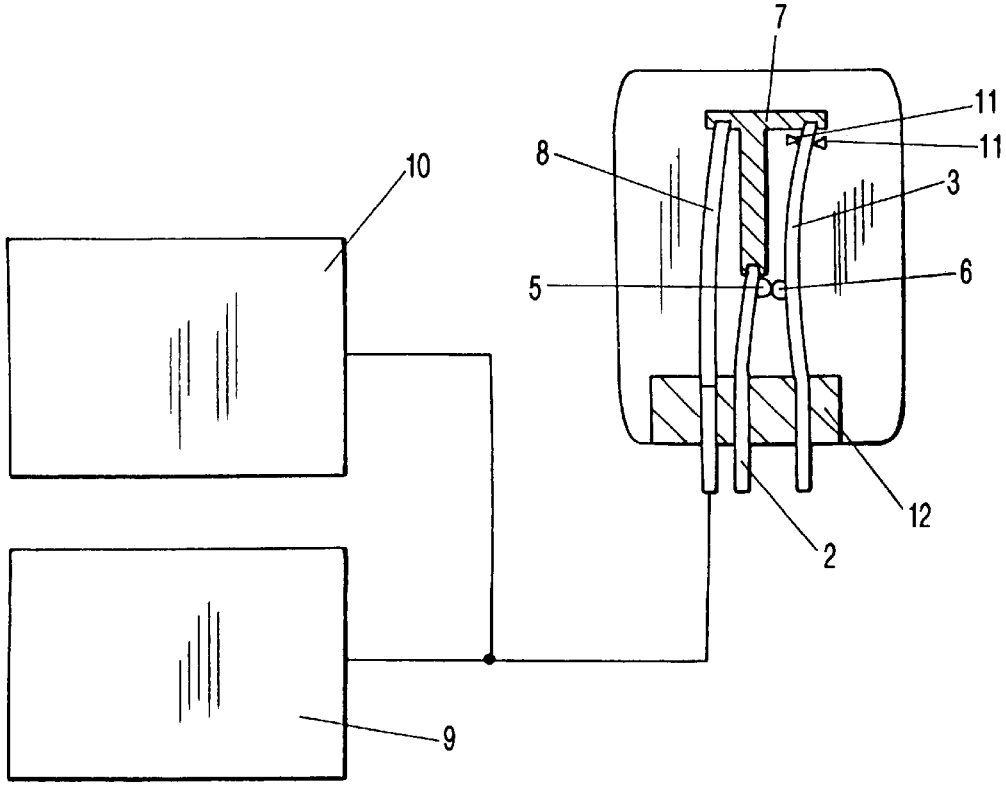
FIG. 2 shows the switch according to FIG. 1 in the switched position.

The switch 1 has a switching element in the form of two contact springs 2, 3 which are supported in a manner known per se in the switch housing 4. The ends of the contact springs 2, 3 projecting from the housing 4 provide contact pins via which current is guided in a manner known per se. The two contact springs 2, 3 each have a contact element 5, 6. It is also possible that the contact springs 2, 3 cooperate directly with one another. The two contact springs 2, 3 are connected to one another at a fixed distance by a slide 7. The slide 7 is displaced or moved by power converter 8. The power converter 8 may be in the form of a ferroelectric piezo ceramic element, a foil, which may be comprised of lead-zirconate-titanate or polyvinylidene fluoride or may be comprised of a magnetostrictive rare earth metal such as, i.e., Terefenol-D. When the power converter 8 is excited and deflected, the slide 7 is correspondingly moved. The two contact springs 2, 3 are then elastically bent in a manner to be discussed in the following such that the two contact elements 5, 6 come into contact with one another (FIG. 2).

The power converter 8 is supported within the switch housing 4 and connected to a control electronic device 9 and to a processing electronic device 10.

In the case that the contact elements 5, 6 of the contact springs 2, 3 fuse together, the power converter 8, because of the fixed direct connection to the slide 7, remains in the deflected position. Thus, the electric terminal behavior will change, especially the electric impedance. The processing electronic device 10 detects the electric terminal behavior of the power converter 8 and will send a corresponding signal to a monitoring device (not represented). When the contact elements 5, 6 are not fused together, this monitoring device will receive a corresponding signal. In turn, it will send a corresponding signal to the control electronic device 9 which triggers the switch 1. When the contact elements 5, 6 are fused together, the processing electronic device 10 will detect this event, and a corresponding locking signal is supplied to the monitoring device. In turn, the monitoring device will send a corresponding signal to the control electronic device 9 so that the switch 1 is no longer triggered.

When the power converter 8, in the shown embodiment a piezoelement, is excited, its impedance will change and thus also the voltage and the current. The excited power converter 8 is elastically deformed and thus moves the slide 7 so that the contact springs 2, 3 are elastically deformed and their contact elements 5, 6 will come into contact with one another. During normal operation of the switch 1 the contact springs 2, 3 will return into their rest position represented in FIG. 1 when the power converter 8 is no longer excited. In the rest position the two contact elements 5, 6 are spaced from one another. When, however, the contact elements 5, 6 adhere to one another due to fusing, the power converter 8 will remain deflected because it is fixedly connected via the slide 7 to the contact springs 2, 3. This is detected by the processing electronic device 10 which then, in cooperation with the control electronic device 9, ensures that the switch 1 will no longer be triggered. In addition to the aforementioned contact fusing, any other permissible or impermissible states of the switch may be detected, i.e., a fracture of the power converter 8 or a fracture of the slide 7.

The slide 7 is fixedly connected to the contact spring 2 and is approximately T-shaped in cross-section. At one side of the cross-bar of the slide 7 the power converter 8 and at the other side the other contact spring 3 are fastened. In the vicinity of its upper end, adjacent to the cross-bar of the slide 7 the contact spring 3 is supported between an abutment including two abutment members 11 provided at the housing. The lower ends of the contact springs 2, 3 and the power converter 8 are clamped in a contact socket 12 of the switch 1.

When the energy converter 8 in the shown embodiment is excited, it is elastically bent to the right. Thus, the slide 7 is displaced by the power converter 8 to the right in the representation of FIG. 2. Since the slide 7 is seated on the upper end of the contact spring 2, which, in turn, is clamped with its lower end within the contact socket 12, the contact spring 2 is elastically deformed to the right. The contact spring 3 is thus elastically deformed because it is also directly connected to the slide 7. Because of the presence of the two abutment members 11, the contact spring 3 is elastically deformed counter to the deformation direction of the contact spring 2. Accordingly, the two contact elements 5, 6 of the two contact springs 2, 3 will contact one another. When the switch 1 is released, the power converter 8 is returned into its initial position according to FIG. 1. Via slide 7 the two contact springs 2, 3 are returned into their rest position in which they are preferably positioned parallel to one another as well as parallel to the power converter 8.

Since the two contact springs 2, 3 are deformed simultaneously but in opposite directions, the contact elements 5, 6 are brought into contact with sufficient pressure. Even when with increasing service life the contact elements 5, 6 will be slowly consumed, the opposite movement of the contact springs 2, 3 ensures that the contact elements 5, 6 will contact one another with sufficient pressure. A great advantage of the inventive arrangement is a very short travel path resulting from the opposite movement of the contact springs 2, 3.

Figure 3:
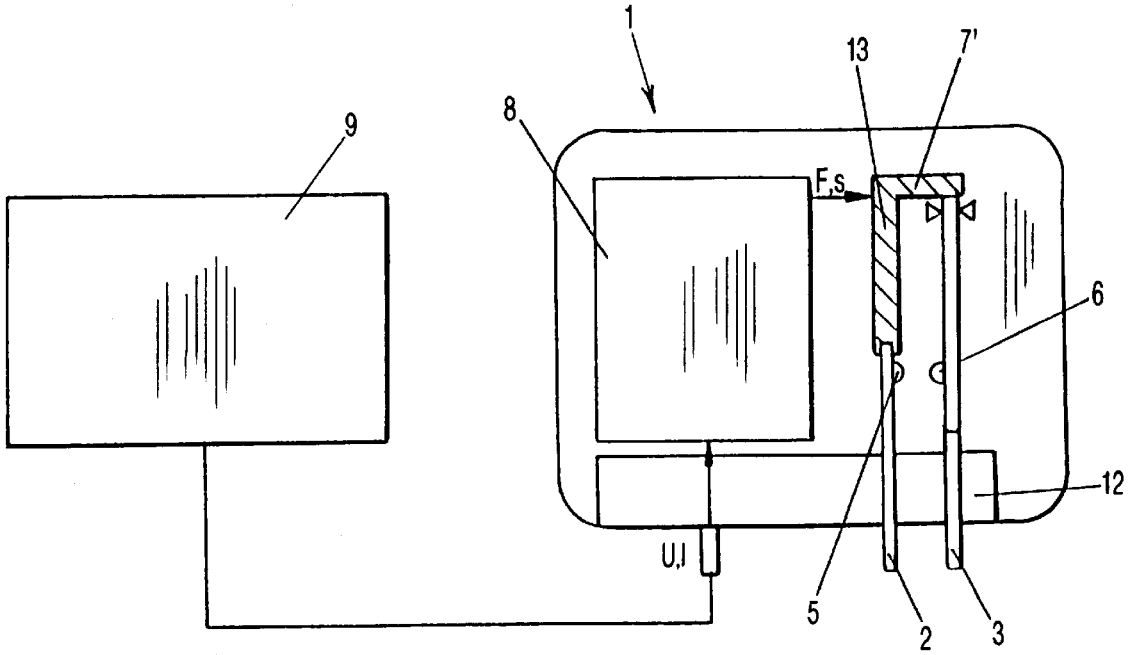
FIGS. 3–4 show in representations corresponding to FIGS. 1 and 2 a second embodiment of the inventive switch drive system.
Figure 4:
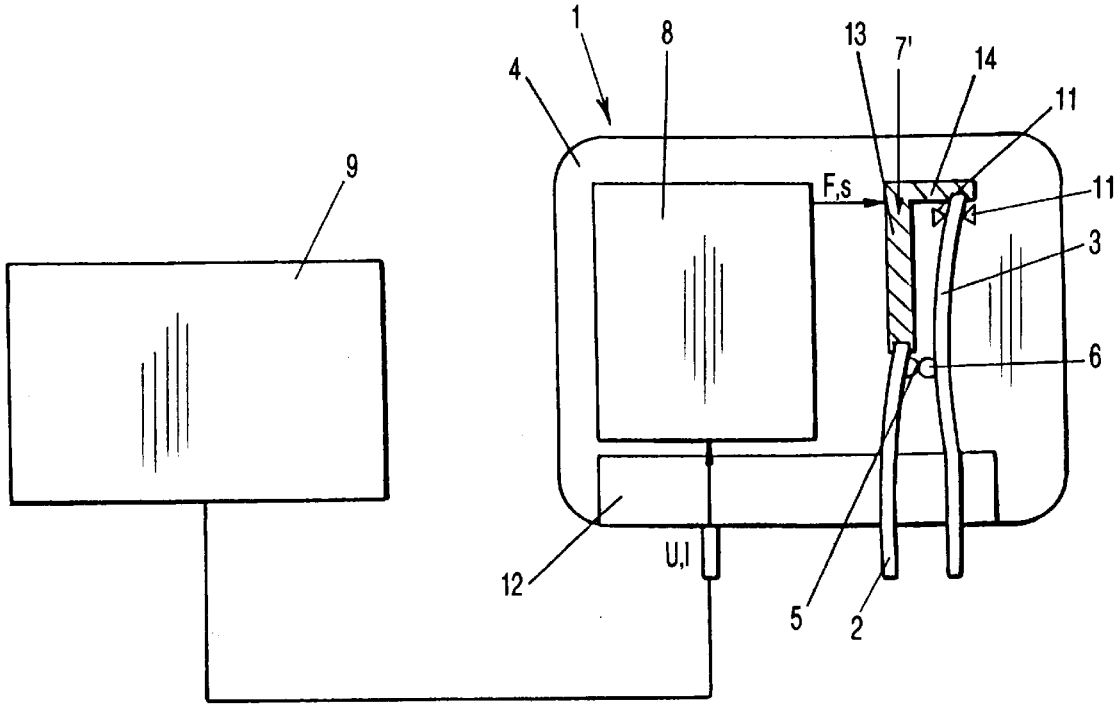
Figure 5:
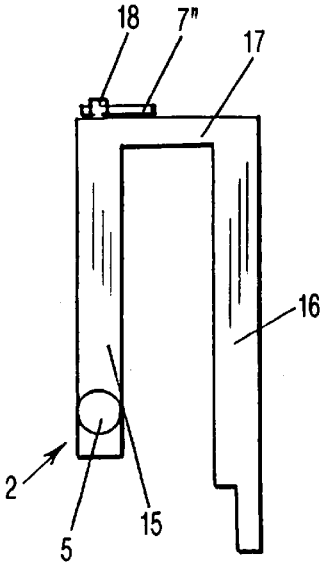
FIG. 5 shows an end view of a first contact spring of a further embodiment of the inventive switch drive system in a rest position.

In the embodiment according to FIGS. 3 and 4, a power converter 8' is used for actuating the switch 1' (embodied in an exemplary manner as a relay). This power converter 8' may be provided by a ferroelectric piezo ceramic material, a foil, for example, comprised of lead-zirconate-titanate or polyvinylidene fluoride, or by a magnetostrictive rare earth metal, such as, i.e., Terefenol-D. When the power converter 8' is deflected by applying current or voltage, the slide 7' of the switch 1 is displaced such that the contact elements 5', 6' of the two contact springs 2', 3' will contact one another (FIG. 4). In the schematic representation of FIGS. 3 and 4 the deflection of the power converter 8' produced a force F as well as a corresponding displacement travel S, represented schematically by an arrow. The power converter 8' is actuated by the control electronic device 9'.

The slide 7' is L-shaped in cross-section. Its longer leg 13 is mechanically directly connected to the contact spring 2' and its shorter leg 14 is mechanically directly connected to the contact spring 3'. The two contact springs 2', 3' are clamped into the contact socket 12 of the switch housing 4 in a manner known per se. The contact spring 2' is fastened with its upper end at the free end of the leg 13 of the slide 7' (see FIGS. 3 and 4). The upper end of the contact spring 3' is fastened in the vicinity of the free end of the shorter leg 14 of the slide 7'. Furthermore, the contact spring 3' extends with its upper end between the two abutment members 11 which are fastened at the switch housing 4.

When the switch 1 is not actuated, the two contact springs 2', 3' extend parallel to one another and vertically, as shown in FIG. 3. The longer leg 13 of the slide 7' is flush with the contact spring 2'. When the switch 1 is actuated and the power converter 8', which is, e.g., a piezo element, is deflected, the slide 7' is displaced to the right in FIG. 3. Thus, the contact spring 2' which is clamped with its lower end within the contact socket 12', is moved to the right in an elastic fashion, as can be seen in FIG. 4. At the same time, the contact spring 3' is also displaced to the right by the slide 7'. Because of the presence of the abutment members 11' and because of the clamping action within the contact socket 12', the contact spring 3' is elastically deflected counter to the deflection direction of the contact spring 2'. Thus, the contact elements 5', 6' will come into contact after travelling a very short distance with already sufficient contact pressure. As soon as the power converter 8' is no longer supplied with current or voltage, the slide 7' is returned by the force of the prestressed contact spring 2' into the initial position shown in FIG. 3. The contact springs 2', 3' are thus returned into their initial positions.

The contact spring 3', however, must not be rigidly connected to the slide 7'. It is sufficient that the upper end of the contact spring 3' abuts the end face of the leg 14 of the slide 7'. When the slide 7' is displaced to the right in the aforementioned manner, the contact spring 3' in this case is also elastically deflected counter to the contact spring 2'. Such an embodiment can also be provided in the embodiment according to FIGS. 1 and 2.

In the shown embodiments the contact spring 3' is clamped between two abutment members 11'. It is sufficient to provide only the abutment member 11' at the right side of the drawing in order to deflect the contact spring 3' in the aforedisclosed manner upon displacement by the slide 7'.

Figure 6:
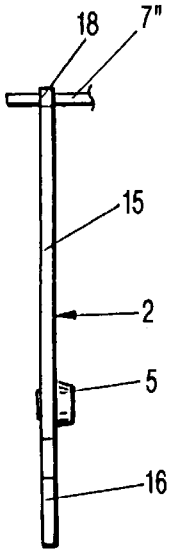
FIG. 6 shows the contact spring of FIG. 5 in a side view.

FIGS. 5 through 11 show a practical embodiment of two contact springs 2" and 3". The two contact springs 2", 3" are U-shaped. The contact spring 2" (FIGS. 5 and 6) has two parallel legs 15, 16, whereby the leg 16 is longer than the leg 15. The two legs 15, 16 are connected to one another by a perpendicularly extending connecting stay 17. The leg 16 is clamped with its lower end, e.g., in the contact socket 12 (FIGS. 1 through 4) of the switch housing 4, while the shorter leg 15 which in the vicinity of its free end is provided with the contact element 5", is free, i.e., is not clamped in. Opposite the leg 15 a projection 18 projects from the stay 17 and has connected thereto the slide 7". When the switch is not actuated, the two legs 15, 16 and the stay 17 of the contact spring 2" are positioned in a common plane (FIG. 6). The two legs 15, 16 are advantageously of the same width while the stay 17 is more narrow. Advantageously, the contact spring 2" is formed of a stamped part that can be stamped from a simple spring band.

The contact spring 3" has also two parallel legs 19, 20 that are connected by a connecting stay 21. The leg 20 is longer than the leg 19 and is clamped with its free end e.g., within the contact socket 12 of the switch housing 4 (FIGS. 1 through 4). The legs 19, 20 have preferably the same width, while the stay 21 which extends perpendicularly to the legs, has a relatively smaller width. The contact spring 3" is also advantageously stamped as a stamped part from a spring band.

In the plane of the leg 19, a projection 22 is provided that projects past the stay 21 and has connected thereto the slide 7". In the vicinity of the free end of the leg 19 the contact element 6 is provided.

Figure 9:
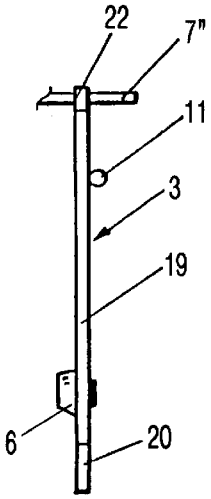

When the switch 1" is not actuated, the legs 19, 20 and the stay 21 are positioned in a common plane (FIG. 9). The leg 19 rests at the abutment member 11" which is provided in the area between the contact element 6" and the stay 21. In the represented embodiment, the abutment 11", provided at the side of the leg 19 opposite the contact element 6", is positioned closer to the stay 21 then to the contact element 6".

Figure 7:
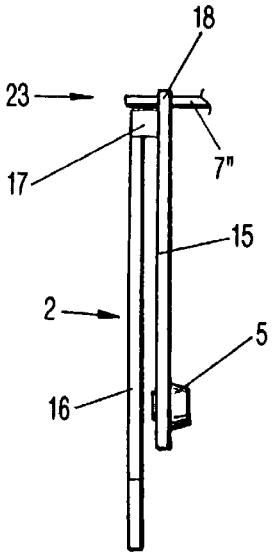
FIG. 7 shows the contact spring according to FIG. 5 in the switched position.
Figure 8:
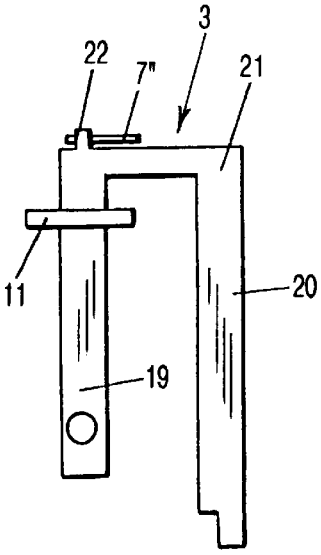
FIGS. 8–10 show in representations corresponding to FIGS. 5 through 7 a second contact spring of the inventive drive system.
Figure 10:
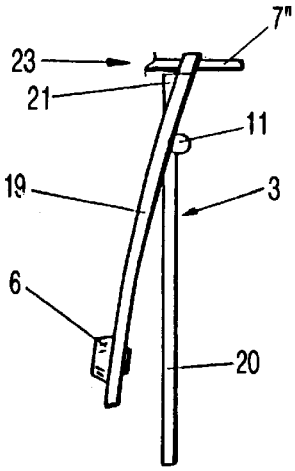
Figure 11:
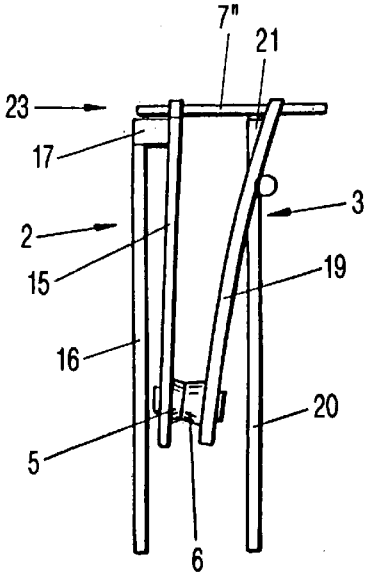
FIG. 11 shows the two contact springs of the inventive drive system in the switched position.

The slide 7" is plate-shaped and connected by projections 18 and 22 mechanically fixedly to the contact springs 2" and 3". In the initial position the two contact springs 2", 3" are spaced at a distance to one another in parallel planes. When the switch 1" is actuated, the slide 7" is displaced in the direction of arrow 23 as shown in FIGs. 7, 10, 11. Since the two contact springs 2", 3" are connected to the slide 7", they are accordingly elastically deformed. Since the leg 16 of the contact spring 2" is clamped, the stay 17 is elastically bent in a direction transverse to its plane (FIG. 7) so that the two legs 15, 16 of the contact spring 2" are now positioned in parallel planes.

The leg 20 of the contact spring 3" is also clamped so that upon movement of the slide 7" the stay 21 is elastically deformed transverse to its plane (FIG. 10). Since the other free leg 19 is supported at the abutment member 11", it is elastically deformed in the opposite direction relative to the leg 15 of the oppositely arranged contact spring 2". Thus, the two contact elements 5", 6" of the contact springs 2", 3" will come into contact with the required pressure (FIG. 11).

When the switch 1" is no longer actuated and the slide 7" has returned into its initial position, the legs 15, 19 and the legs 17, 21 are returned into their undeformed initial positions.

The two contact springs 2", 3" of the switch 1" embodied as a relay are moved opposite to one another for closing or opening the contact. Thus, the travel path is very short so that the closing or opening times of the switch are very minimal. A special advantage of the inventive embodiment is that for all of the above described embodiments the so-called follower path is obsolete. The follower path refers to the movement of the slide required in conventional switches, especially relays, for entraining, after contacting of the contact elements, one of the contacts along a certain travel in order to produce the required contact pressure between the two contact elements. Due to the opposed movement of the contact elements 5", 6" such an additional travel path (follower path) is no longer needed. Even when the contact elements 5", 6" will wear over time, the opposed movement ensures that the contact pressure is always sufficiently great.

The abutment 11" provided at the housing in the embodiment according to FIGS. 5 through 11 has such a length that the leaf-shaped leg 19 of the contact spring 3 extends over its entire width across the abutment 11". Preferably, the abutment 11" is longer than the width of the leg 19 so that even for assembly tolerances a secure support at the abutment is ensured. Advantageously, it has a circular cross-section in order to ensure elastic deformation of the leg 19 in a simple manner.

In the disclosed and represented embodiments the contact springs 2, 2', 2"; 3, 3', 3" are not prestressed in their initial position in which the two contact elements 5, 5', 5"; 6, 6', 6" are spaced from one another. However, the contact springs 2, 2', 2"; 3, 3', 3" may be elastically deformed in their rest position in which the contact elements 5, 5', 5"; 6, 6', 6" are spaced from one another. When the slide 7, 7', 7" is displaced from its initial position in the aforedescribed manner, the elastic prestress of the corresponding contact spring 2, 2', 2" or 3, 3', 3" moves it into the respective displaced position. For displacement of the contact springs 2, 2', 2"; 3, 3', 3" the slide 7, 7', 7" must therefore exert a relatively great force.

The slide 7, 7', 7" can be displaced by power or bending converters 8, 8', 8". The disclosed embodiments and operation can be also used for switches in which the slide 7, 7', 7" in a conventional manner is moved by the armature of a solenoid. Due to the opposite movement of the contact element 5, 5', 5"; 6, 6', 6" for closing and opening, only very short travel paths are required so that the drive of the slide 7, 7', 7" can be used especially advantageously with the disclosed power converter or bending converter 8, 8', 8". Depending on the position of one or more abutment members 11, 11', 11" along the contact spring 3, 3', 3" the elastic deformation of the contact spring 3 and the required force can be adjusted as needed. The contact springs 2, 2', 2"; 3, 3', 3" including the slide 7, 7', 7" and optionally the power converter 8, 8', 8" provide a great mechanical stiffness which is also beneficial in regard to the reducing switching times.

The present invention is, of course, in no way restricted to the specific disclosure of the specification and drawings, but also encompasses any modifications within the scope of the appended claims.

What is claimed is:

1. A switch comprising at least two contact springs and a common slide, connected to said at least two contact springs, wherein said at least two contact springs have facing sides and each one of said at least two contact springs comprises at least one contact element positioned on said facing sides, wherein said slide moves said facing sides with said contact elements in opposite directions relative to one another between an open position and a closed position of said switch and has a sliding direction that is parallel to a direction of movement of said facing sides in said opposite directions.

2. A switch according to claim 1, further comprising an abutment, wherein a first one of said at least two contact springs rest on said abutment without being fastened thereto.

3. A switch according to claim 2, wherein said abutment is arranged at a side of said first contact spring facing away from a second one of said at least two contact springs.

4. A switch according to claim 2, wherein said abutment is provided in the vicinity of said slide.

5. A switch according to claim 1, wherein at least a first one of said at least two contact springs is directly connected to said slide.

6. A switch according to claim 5, wherein a second one of said at least two contact springs is connected to said slide.

7. A switch according to claim 5, wherein a second one of said at least two contact springs is positioned in a travel path of said slide.

8. A switch according to claim 1, further comprising a power converter for moving said slide.

9. A switch according to claim 8, wherein said power converter is a piezoelectric bending converter.

10. A switch according to claim 1, further comprising an abutment, wherein a first one of said at least two contact springs rests on said abutment in said closed position of said contact.

11. A switch according to claim 1, further comprising a housing and an abutment connected to said housing, wherein a first one of said at least two contact springs rests on said abutment.

12. A switch comprising at least two contact springs and at least one slide for moving said at least two contact springs in opposite directions relative to one another between an open position and a closed position of said switch, wherein said at least two contact springs have facing sides and each one of said at least two contact springs comprises at least one contact element positioned on said facing sides, wherein said slide has a sliding direction that is parallel to a direction of movement of said at least two contact springs in said opposite directions, wherein said at least two contact springs have a U-shape including two legs and a connecting stay.

13. A switch according to claim 12, wherein said at least two contact springs are elastically prestressed in said closed position of said contact.

14. A switch according to claim 12, wherein said connecting stay is elastically prestressed in said closed position of said contact.

* * * * *